US006834727B2

(12) United States Patent
Wills et al.

(10) Patent No.: US 6,834,727 B2
(45) Date of Patent: Dec. 28, 2004

(54) EMERGENCY DEFLATE MECHANISM AND METHOD FOR INFLATABLE PACKER ASSEMBLIES

(75) Inventors: Philip Wills, Aberdeenshire (GB); Paul Henley, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 33 days.

(21) Appl. No.: 10/337,670

(22) Filed: Jan. 7, 2003

(65) Prior Publication Data

US 2004/0129432 A1 Jul. 8, 2004

(51) Int. Cl.[7] ..... E21B 33/127

(52) U.S. Cl. ..... 166/387; 166/187; 166/163; 277/333

(58) Field of Search ..... 166/387, 187, 166/264, 191, 162–169; 277/333

(56) References Cited

U.S. PATENT DOCUMENTS

| | | | | | |
|---|---|---|---|---|---|
| 2,629,446 | A | * | 2/1953 | Freling et al. | 277/333 |
| 3,327,781 | A | * | 6/1967 | Nutter | 166/264 |
| 4,082,298 | A | | 4/1978 | Sanford | |
| 4,609,042 | A | * | 9/1986 | Broadus et al. | 166/187 |
| 4,676,096 | A | | 6/1987 | Bardsley et al. | 73/155 |
| 4,676,310 | A | | 6/1987 | Scherbatskoy et al. | |
| 4,712,613 | A | * | 12/1987 | Nieuwstad | 166/53 |
| 5,297,633 | A | | 3/1994 | Snider et al. | |
| 5,353,637 | A | * | 10/1994 | Plumb et al. | 73/152.17 |
| 5,803,186 | A | * | 9/1998 | Berger et al. | 175/50 |
| 6,148,664 | A | * | 11/2000 | Baird | 73/152.38 |
| 6,192,982 | B1 | | 2/2001 | Divis et al. | |
| 6,257,338 | B1 | | 7/2001 | Kilgore | |

* cited by examiner

*Primary Examiner*—David Bagnell
*Assistant Examiner*—Shane Bomar
(74) *Attorney, Agent, or Firm*—Madan, Mossman & Sriram, P.C.

(57) ABSTRACT

Devices and methods are provided that permit a packer element to be deflated in the event of an emergency wherein power to the inflating pump is lost. An inflatable packer assembly having packer elements are selectively inflated by fluid pumped from the wellbore through an inflation tube into the packer elements. The packer assembly includes a deflation sub that houses the components of the emergency deflation mechanism. The deflation sub defines a dumping chamber that is at approximately atmospheric pressure, retains a portion of the inflation line for the packer elements and a means for separating the inflation line. To actuate the emergency deflation mechanism, an operator pulls up on the tubing string. A piston is then moved axially with respect to the housing, causing separation of the inflation line. Fluid from within the packer elements is then released into the dumping chamber to deflate the packer elements. Because the packer elements are subject to external hydrostatic pressure, the fluid contents will readily flow into the dumping chamber.

16 Claims, 3 Drawing Sheets

EMERGENCY DEFLATE MECHANISM AND METHOD FOR INFLATABLE PACKER ASSEMBLIES

BACKGROUND OF THE INVENTION

1. Field of the Invention

The invention relates generally to devices and methods for deflation of an inflatable packer device in the event of a loss of power to the inflation pump or another emergency requiring a secondary method of deflation. In particular aspects, the invention also relates to inflatable packer assemblies that incorporate a deflate sub having a dumping chamber with an interior pressure that approximates atmospheric pressure.

2. Description of the Related Art

Inflatable packer assemblies are well known in the industry. These packer assemblies incorporate an inflatable packer element, or bladder, which is selectively inflated using a pump to flow fluid, such as borehole fluid, into the bladder. The packer element is ordinarily deflated by reversing the pump so that the fluid is flowed out of the bladder. A problem arises if there is an emergency wherein power is lost to the pump. The packer element cannot be deflated and, typically, the packer assembly must be detached from the tubing string. The tubing string is then removed from the borehole and the packer assembly subsequently removed using a fishing tool. This technique, while effective, is costly and time consuming. The well must be essentially shut down so that the tubing string can be removed and the fishing tool run in.

U.S. Pat. No. 5,297,633 issued to Snider et al. describes an inflatable packer assembly wherein a reciprocable fluid piston assembly is used to selectively inflate and deflate the packer. If the packer becomes stuck in the wellbore, the operator can pull up on the tubing string to shear a shear pin, thereby leaving the stuck packer in the well for later retrieval by a fishing tool. This solution for removing a stuck packer should be considered to be a last resort since it requires the well to be closed down, the sampling tool removed from the hole and a fishing device then run into the hole to retrieve the stuck packer. This is costly and time-consuming.

The prior art does teach the use of a bladder's natural shape memory to urge fluid out of the bladder. U.S. Pat. No. 4,676,310 issued to Scherbatskoy et al., for example, describes a transporter device for moving a logging tool. The transporter device includes an expandable bladder that is filled with fluid to become inflated and engage a borehole wall. The fluid is provided from an expandable reservoir. In one construction, the bladder is of a resilient construction that will normally urge fluid to flow back into the expandable reservoir. In practice, however, this arrangement is practically useless since the expandable reservoir is subject to hydrostatic pressure that precludes effective evacuation of the bladder. Little or no flow of fluid can be expected. Furthermore, there is no positive control of deflation.

An example of this is found in U.S. Pat. No. 6,257,338 issued to Kilgore, which describes a tubing string with multiple inflatable packers. The packers are inflated and deflated using a coupling that is conveyed down inside the tubing string on coiled tubing. When deflated, the fluid from the packer flows into the interior of the tubing string. Thus, fluid within the packer element is expected to flow into an area that is under hydrostatic pressure and, if such pressure is sufficiently great, deflation will be unsuccessful.

The arrangements of the prior art demonstrate the absence of an acceptable emergency deflation mechanism. To the inventors' knowledge, there are no conventional arrangements that provide a suitable mechanism for deflation of the packer element in the event of a loss of power to the fluid inflation pump or another such emergency.

There is a need to provide improved methods and devices for rapid and effective deflation of an inflatable packer. The present invention addresses the problems of the prior art.

SUMMARY OF THE INVENTION

The invention provides devices and methods that permit a packer element to be deflated in the event of an emergency wherein power to the inflating pump is lost. The invention also provides a backup procedure in the event that deflation of a packer element using conventional techniques is not successful. The devices and methods of the present invention, therefore, provide a more certain technique for deflation and removal of a packer assembly short of having to detach the packer assembly from the tubing string and fishing it out of the borehole with a separate tool. Thus, the invention offers a significant savings of time and money over the prior art.

In a described embodiment, a well sampling tool is described that incorporates an inflatable packer assembly having packer elements are selectively inflated by fluid pumped from the wellbore through an inflation tube into the packer elements. The packer assembly includes a deflation sub that houses the components of the emergency deflation mechanism. The deflation sub defines a dumping chamber that is at approximately atmospheric pressure. The dumping chamber has a capacity that will accept enough of the fluid contents of the inflated packer elements so that the packer elements become deflated enough to become disengaged from the borehole wall. Additionally, the deflation sub retains a portion of the inflation line for the packer elements and a means for separating the inflation line. In a currently preferred embodiment, the means for separating the inflation line includes a split rod arrangement wherein two reversibly interconnectable portions of the line may be axially separated from one another. To enable separation of the split rod, a hydraulic piston arrangement is formed within the deflation sub having a piston and surrounding piston housing. Shear pins or other frangible members are used to prevent premature movement of the piston and to provide a positive indication of movement of the piston.

To actuate the emergency deflation mechanism, an operator pulls up on the tubing string. The piston is then moved axially with respect to the housing, causing the split rod arrangement to separate the inflation line. Fluid from within the packer elements is then released into the dumping chamber to deflate the packer elements. Because the packer elements are subject to external hydrostatic pressure, the fluid contents will readily flow into the dumping chamber. In the unlikely event that the emergency deflation mechanism fails, the packer assembly may still be separated from the tubing string, in the conventional manner and later retrieved with a fishing tool.

The invention also has applicability to other packer arrangements and mechanical tools that utilize hydraulic fluid to be selectively set within a wellbore.

BRIEF DESCRIPTION OF THE DRAWINGS

In FIG. 1, the packer elements are shown deflated, prior to inflation.

DETAILED DESCRIPTION OF THE PREFERRED EMBODIMENTS

The term "emergency," as used herein, means an event wherein power to a fluid pump used to deflate a packer element is lost, or there is some other malfunction or incident wherein the packer cannot be deflated normally for removal from the wellbore. The term "emergency" also refers to any other event or contingency wherein the pump becomes unavailable or ineffective.

Figure 1:
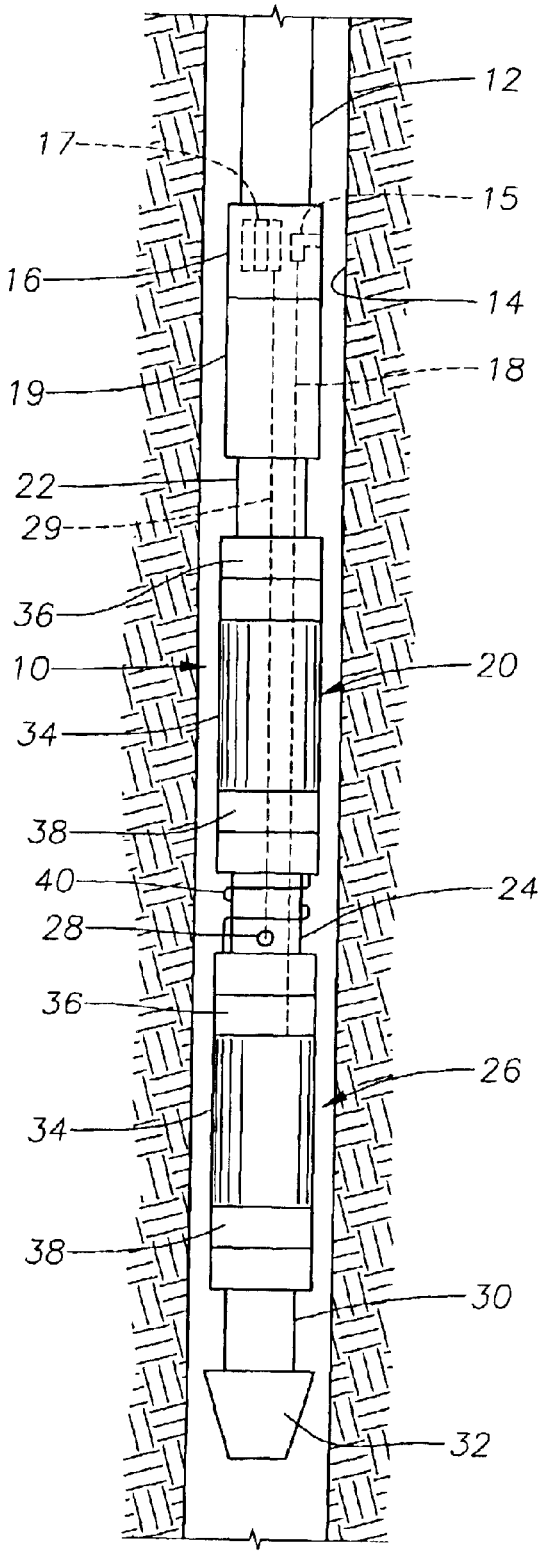
FIG. 1 is a side, cross-sectional view of a wellbore having a sampling tool therein that incorporates an inflatable packer assembly constructed in accordance with the present invention.

Referring first to FIG. 1, an exemplary sampling tool, indicated generally at 10, is shown secured to the lower end of a tubing string 12 within a wellbore 14. The sampling tool 10 is used to obtain selective samples of fluid from certain depths within the wellbore 14. The sampling tool 10 consists of several individual subs, shown in schematic fashion, that are interconnected.

The uppermost portion of the sampling tool 10 is an extraction sub 16 that is secured to the lower end of the tubing string 12. The extraction sub 16 houses sample tanks 17, of a type known in the art, that retain wellbore or formation fluids that are captured by the sampling tool 10. Additionally, the extraction sub 16 houses a submersible pump 15 that draws fluid from within the wellbore 14 and pumps it through an inflation line 18 to the packer elements 34 of the tool 10.

Located beneath the extraction sub 16 is an emergency deflation sub 19, the structure and function of which will be described in detail shortly. The deflation sub 19 is secured to an upper packer assembly 20 by a short mandrel 22. A sampling mandrel 24 interconnects the upper packer assembly 20 to a lower packer assembly 26. The sampling mandrel 24 includes at least fluid port 28 through which borehole fluid may be drawn in. A sampling line 29 extends from the fluid port 28 to the sampling tanks 17 within the extraction sub 16 so that fluid may be drawn into the tanks 17.

A lower mandrel 30 interconnects the lower packer assembly 26 with a bullplug 32. The upper and lower packer assemblies 20, 26 each have an inflatable packer element, or bladder, 34. The inflatable packer elements 34 are of a type known in the art, typically formed of an elastomeric material and inflated by filling with fluid. The inflation line 18 provides a fluid pathway between the packer elements 34 and the wellbore 14. When so inflated, the packer elements 34 expand radially to engage and seal against the wall of the wellbore 14. Each of the packer assemblies 20, 26 includes collars 36, 38 that are disposed upon and affixed to each end of the packer element 34. The upper collars 36 are fixed against axial movement, while the lower collars 38 are axially moveable when required to compensate for inflation of the packer elements 34. In FIG. 1, the tool 10 is shown in an unset position, such as during run-in, wherein the packer elements 34 are in an uninflated condition and the tool 10 may be moved upwardly and downwardly within the wellbore 14.

Figure 2:
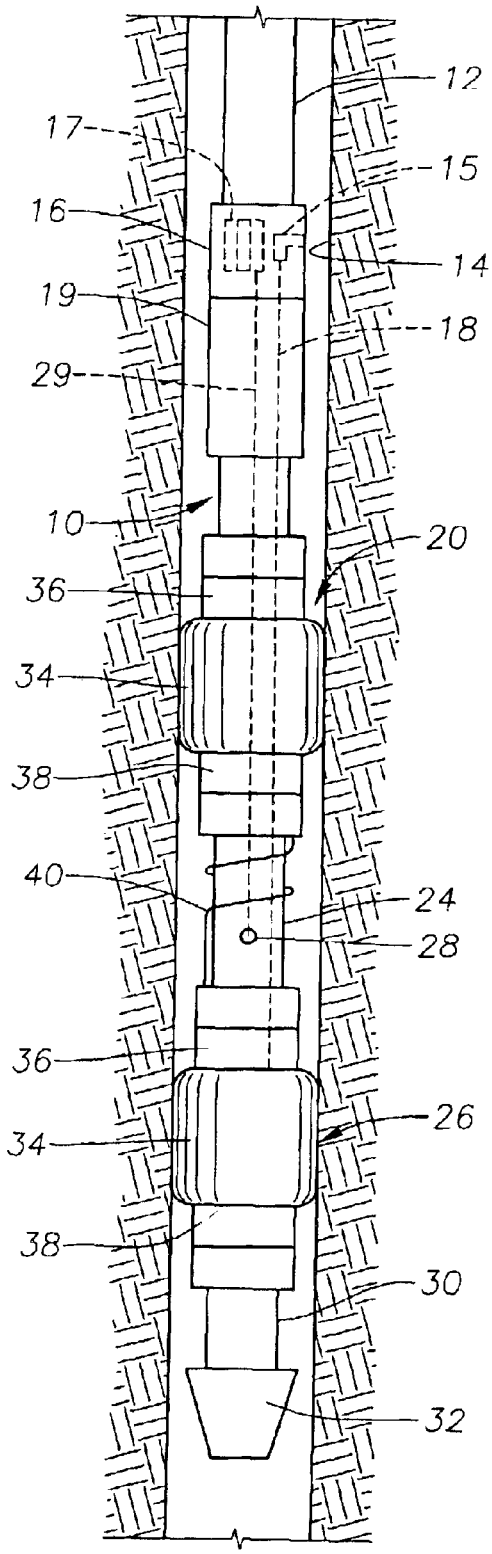
FIG. 2 is a side, cross-sectional view of the sampling tool shown in FIG. 1 with the packer elements now inflated to seal the wellbore.

FIG. 2 shows the tool 10 set within the wellbore 14, the packer elements 34 having been inflated so as to seal against the wall of the borehole 14. The elements 34 are inflated by pumping fluid from the borehole 14 through the inflation line 18 and into each of the packer elements 34. It is noted that a portion 40 of the inflation line 18 is coiled about the circumference of the sampling mandrel 24. When the upper packer element 34 is inflated, as shown in FIG. 2, the lower collar 38 moves axially upwardly, thereby increasing the distance between it and the upper collar 36 of the lower packer assembly 26. The coiled portion 40 compensates for this increase in distance, as can be appreciated by reference to FIGS. 1 and 2.

Figure 3:
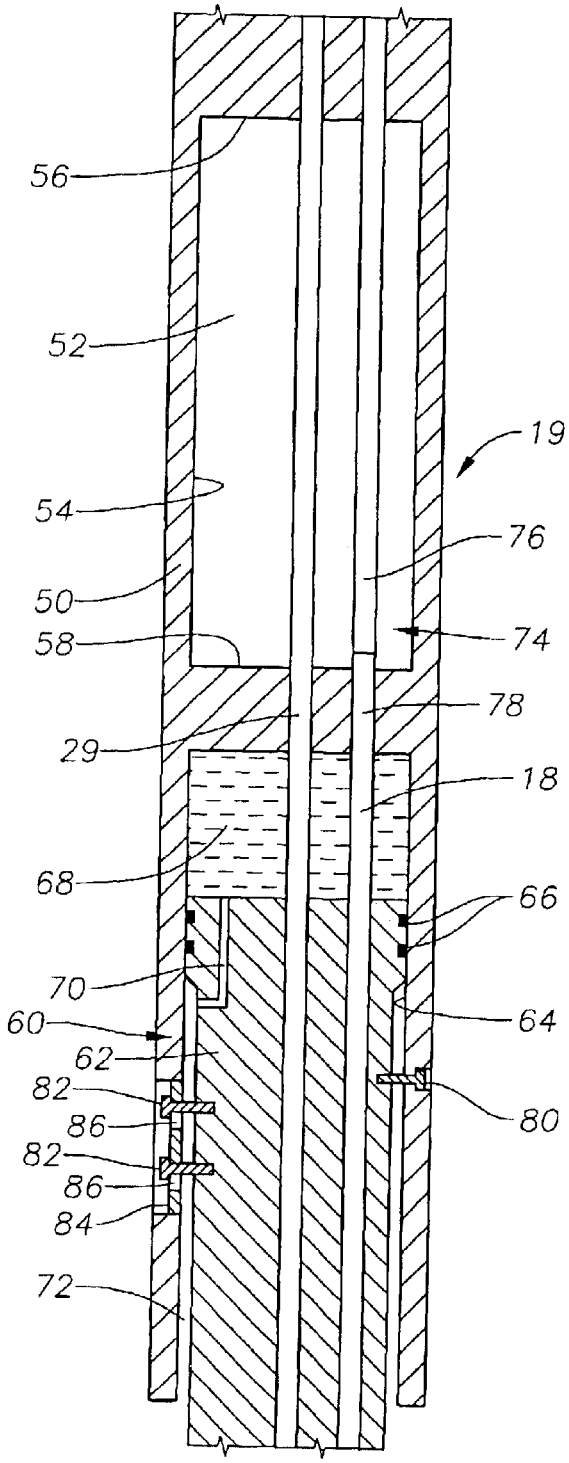
FIG. 3 is an enlarged cross-sectional view of portions of the deflate sub portion of the inflatable packer assembly shown in FIG. 1 prior to an emergency deflation of the packer elements.
Figure 4:
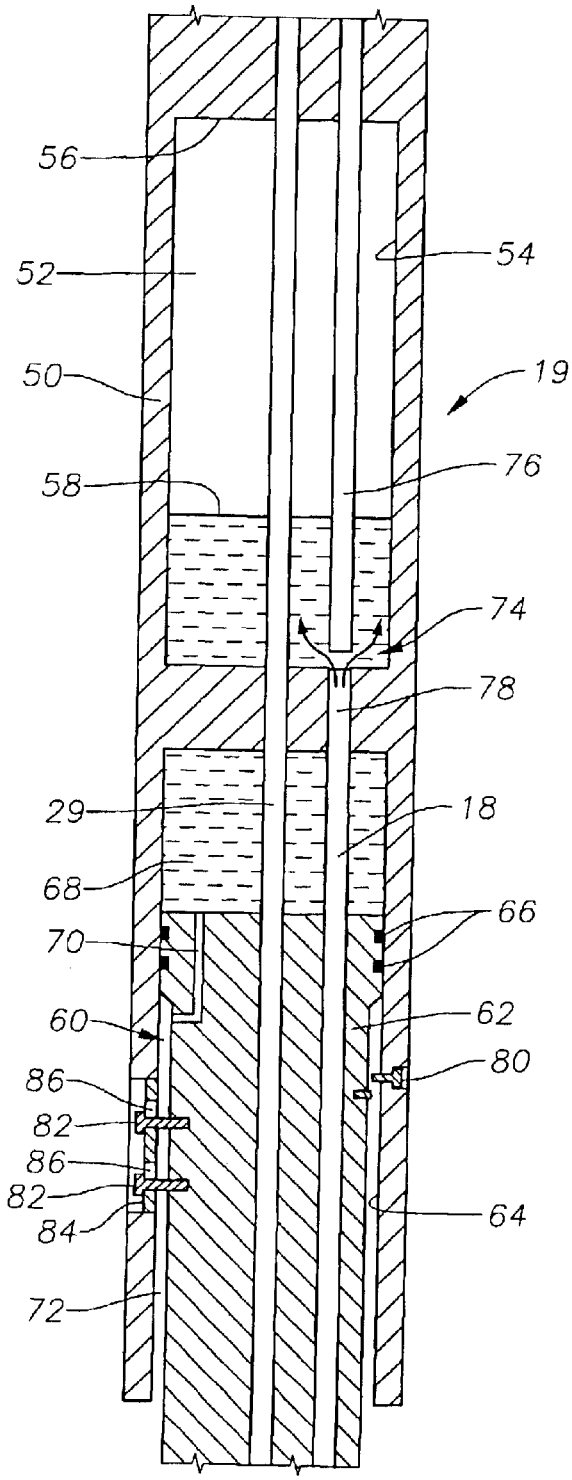
FIG. 4 is a view of the deflate sub portions shown in FIG. 3 after actuation of the emergency deflation mechanism.
Figure 5:
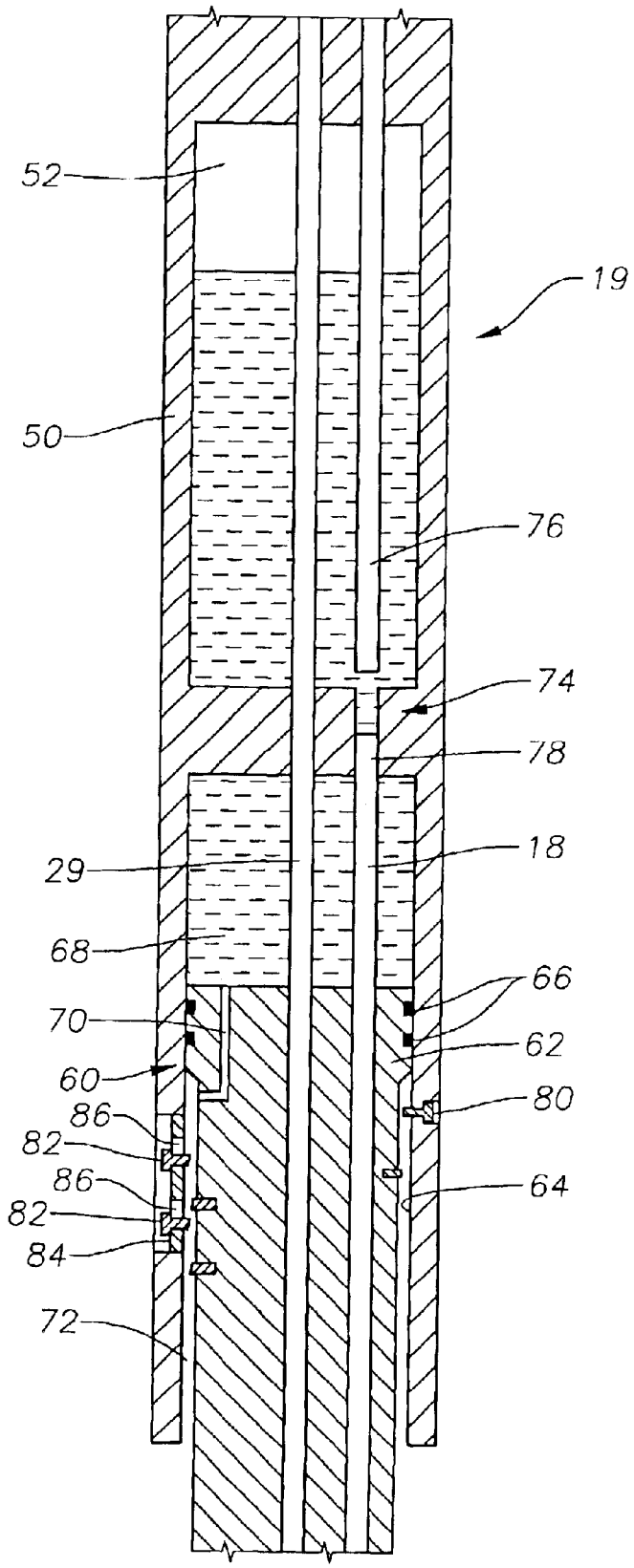
FIG. 5 is a view of the deflate sub portions shown in FIGS. 3 and 4 following release of the packer assembly from the tubing string.

Referring now to FIGS. 3, 4 and 5, the interior of the deflation sub 19 is shown in cross-section. The deflation sub 19 includes a tubular housing 50 that defines a dumping chamber 52 therewithin. The dumping chamber 52 is empty of liquid initially and of a sufficient volume to accommodate enough of the fluid contents of the two packer elements 34 to ensure deflation of the packer elements 34 so that the elements 34 become disengaged from the wall of the borehole 14. Further, the dumping chamber 52 is maintained at a pressure that is significantly lower than the hydrostatic pressure within the wellbore 14. In a currently preferred embodiment, the dumping chamber 52 is at approximately atmospheric pressure. No special preparation of the dumping chamber 52 is required. The chamber 52 will contain normal atmospheric gases and should be sealed prior to running into the borehole 14. The dumping chamber 52 is bounded by the outer radial wall 54 of the housing 50 and at each axial end by a bulkhead or wall 56, 58.

Beneath the dumping chamber 52 is a hydraulic piston assembly, generally indicated at 60, that includes a piston 62 reciprocally retained within a piston cylinder, or piston housing 64. O-ring seals 66 surround the piston 62 and create a fluid seal against the piston housing 64. A hydraulic chamber 68 is formed at the upper end of the piston 62. The hydraulic chamber 68 is filled with hydraulic fluid. A hydraulic metering port 70 is disposed through the piston 62 to permit fluid communication between the hydraulic chamber 68 and the annulus 72 defined between the piston 62 and the piston housing 64 on the opposite side of the seals 66. When the piston 62 is moved with respect to the piston housing 64, hydraulic fluid is metered through the port 70 between the annulus 72 and the chamber 68.

The inflation line 18 and the sampling line 29 are disposed axially through the housing 50 of the deflation sub 19 so that each passes through the piston 62, the hydraulic chamber 68 and the dumping chamber 52. The inflation line 18 includes a separable split rod portion 74 wherein a upper portion 76 and a lower portion 78 are reversibly affixed together. The lower portion 78 leads to the packer elements 34 and is secured within the piston 62 so as to move with the piston 62. The upper portion 76 is fixedly disposed within the housing 50.

A first shear screw 80, or set of shear screws, is disposed though the outer housing 50 and the piston 62. The shear screw 80 secures the piston 62 axially with respect to the housing 50 and is a frangible member that will break upon application of a preset amount of axial force to the housing 50. A second set of shear screws 82 is also disposed through the housing 50 and into the piston 62. This set of shear screws 82 are each placed through a plate 84 in the housing 50 having enlarged openings 86. The openings 86 permit some movement of the shear screws 82 therewithin. The second set of shear screws 82 requires a greater force to shear than the first shear screw 80.

In operation, the sampling tool 10 is lowered to a desired depth within the wellbore 14 and is then set within the wellbore 14 by inflation of the packer assemblies 20, 26. The pump 15 is actuated to flow wellbore fluid into the packer elements 34. The set position for the tool 10 is illustrated in FIG. 2. Once the tool 10 is set, formation fluids are then drawn into the sample tanks 17 through port 28 and sampling line 29. When it is desired to unset the tool 10, either to remove it from the wellbore 14 or to move it to another location, the pump 15 is actuated to reverse the flow of fluid, drawing it from the packer elements 34 and returning it to the wellbore 14. This is the conventional method of unsetting the tool 10. In an emergency, the packer elements 34 are deflated by pulling up on the tubing string 12 and, thus, the housing 50 of the deflation sub 19. A predetermined amount of upward force is applied to the tubing string 12 that is sufficient to shear the first shear screw 80 but not the second set of shear screws 82. The first shear screw 80 separates, thus permitting the housing 50 to move with respect to the piston 62. Fluid is metered through the metering port 70 into the hydraulic chamber 68 to compensate for the displacement of the piston 62. The second set of shear screws 82 are moved within the openings 86 but are not broken. As this movement of the piston 62 occurs, the split rod arrangement 74 separates the upper and lower portions 76, 78 of the inflation line 18 proximate the dumping chamber 52. This position is shown in FIG. 4. With the upper and lower portions 76, 78 now separated, fluid within the packer elements 34 exits the lower portion 78 into the dumping chamber 52. The fluid is urged into the chamber by the pressure differential between the hydrostatic pressure within the wellbore 14 (acting upon the outside of the packer elements 34) and the lower pressure within the dumping chamber 52. The packer elements 34 are thereby deflated at least sufficiently to permit them to be disengaged from the borehole wall.

In the unlikely event that the packer elements 34 are not successfully deflated using the above-described method, the tool 10 may then be separated from the tubing string 12 to permit later removal by a fishing tool. To separate the tool 10 from the tubing string 12, a second upward force is applied to the tubing string 12. The second upward force is greater than the first upward force previously applied to shear screw 80. The second upward force is sufficient to shear the second set of screws 82 as shown in FIG. 5. The second upward force separates the housing 50 from the piston 62. The sampling line 29 will be broken away as well as the deflation sub 19 is separated from the packer assemblies 20, 26.

It will be understood by those of skill in the art that the devices and methods of the present invention are not useful only with inflatable packer devices but are also applicable to other tools and devices that are set using hydraulic fluid, such as a mechanical packer device that uses hydraulic setting. Those of skill in the art will recognize that numerous modifications and changes may be made to the exemplary designs and embodiments described herein and that the invention is limited only by the claims that follow and any equivalents thereof.

What is claimed is:

1. An inflatable packer assembly for use in a borehole comprising:

a packer element that is selectively inflatable by filling with fluid and deflatable by expelling of fluid;

a fluid pathway for transmitting fluid to the packer element from a fluid source; and a fluid dumping chamber operably associated with the packer element to receive fluid therefrom during deflation of the packer element, the fluid dumping chamber having an internal pressure that is below hydrostatic pressure within the borehole.

2. The inflatable packer assembly of claim 1 wherein the internal pressure approximates atmospheric pressure.

3. The inflatable packer assembly of claim 1 wherein the fluid pathway comprises an inflation line having a split rod assembly that permits the inflation fine to be readily separated into two portions so that fluid may enter the dumping chamber.

4. The inflatable packer assembly of claim 3 further comprising a hydraulic piston assembly for separating the inflation line, the hydraulic piston assembly comprising:

a tubular outer piston housing; and a piston reciprocally retained within the piston housing.

5. The inflatable packer assembly of claim 4 wherein the piston is releasably secured to the piston housing by a first frangible member that breaks upon application of a first predetermined force to the hydraulic piston assembly.

6. The inflatable packer assembly of claim 5 wherein the piston is further releasably secured to the piston housing by a second frangible member that breaks upon application of a second predetermined force to the hydraulic piston assembly, the second predetermined force being greater than the first predetermined force.

7. The inflatable packer assembly of claim 1 wherein the fluid dumping chamber is defined within a deflation sub that is selectively releasable from the packer element.

8. A device for deflating an inflatable packer element within a wellbore comprising:

a housing defining a fluid dumping chamber therein for receiving fluid from within the inflatable packer element, the dumping chamber having an internal pressure that is below wellbore hydrostatic pressure;

a fluid pathway between the inflatable packer element to be deflated and the fluid dumping chamber; and a release mechanism for selectively releasing fluid from the inflatable packer element into said dumping chamber.

9. The device of claim 8 wherein the release mechanism comprises a split rod assembly incorporated into the fluid pathway.

10. The device of claim 9 wherein the release mechanism further comprises a hydraulic piston assembly.

11. The device of claim 8 wherein the internal pressure of the dumping chamber approximates atmospheric pressure.

12. The device of claim 8 wherein the housing comprises a separate deflation sub that is releasably secured to the inflatable packer element.

13. A method for deflating an inflatable packer element that is filled with fluid, the method comprising the steps of:

providing a fluid pathway from the packer element to a fluid dumping chamber having an internal pressure that is below wellbore hydrostatic pressure; and allowing packer element shape memory and hydrostatic wellbore pressure to expel fluid from the packer element into the dumping chamber.

14. The method of claim 13 wherein the internal pressure of the dumping chamber is approximately atmospheric pressure.

15. The method of claim 13 wherein the step of providing a fluid pathway to the dumping chamber comprises severing a fluid inflation line.

16. The method of claim 15 wherein the fluid inflation line is severed by actuating a hydraulic piston assembly.

* * * * *